United States Patent [19]

Neilsen

[11] 4,441,348

[45] Apr. 10, 1984

[54] KEY RETAINING DEVICE

[76] Inventor: Hildaur L. Neilsen, 2 Juniper St., Metuchen, N.J. 08840

[21] Appl. No.: 322,265

[22] Filed: Nov. 17, 1981

[51] Int. Cl.[3] ..... E05B 11/00; E05B 73/00

[52] U.S. Cl. ..... 70/389; 70/19

[58] Field of Search ..... 70/389, 63, 19, 456 R, 70/441; 194/51, 59, 65

[56] References Cited

U.S. PATENT DOCUMENTS

| | | | |
|---|---|---|---|
| 1,934,319 | 11/1933 | Newbauer | 70/63 |
| 4,090,380 | 5/1978 | Bianco | 70/19 |
| 4,315,420 | 2/1982 | Oliver | 70/389 |
| 4,367,827 | 1/1983 | Keller | 70/389 |

*Primary Examiner*—Robert L. Wolfe

*Attorney, Agent, or Firm*—Weingram & Klauber

[57] ABSTRACT

A key retaining device for capturing and selectively locking therein a portion of the working section of a key. When the key is locked in the device, its handle section is visible so that the presence of the key can be instantly determined without unlocking of the apparatus, yet the key cannot be removed from the device until unlocked with a master key. Retention of the key within the housing is accomplished by a clamping mechanism employing a pair of blades which reciprocate toward each other to clamp the working section of the key therebetween and reciprocate away from each other to permit free removal of the key, the reciprocation resulting from manipulation of the master key in a lock assembly.

14 Claims, 5 Drawing Figures

KEY RETAINING DEVICE

BACKGROUND OF THE INVENTION

1. Field of the Invention

The present invention relates to apparatuses for permitting keys to be stored in an unusable condition, and more particularly to a key retaining device which permits a key to be prominently displayed, yet totally unavailable for use, unless released by authorized means.

2. Description of the Prior Art

There are many instances when it is desirable to leave a key proximate to the lock which it unlocks, yet to place the key in a circumstance such that it cannot be used by unauthorized personnel. Typical examples of such instances include the practice of real estate brokers leaving keys on the doors of houses which are for rent or sale in a locked box wherein a key is placed totally inside the box and any authorized real estate broker can unlock the box and therefore gain access to the key through use of a master key so that the locked key can be used to open a door. A similar application is also found in an automobile parking lot. Especially in lots with very large capacities, the tagging of keys and their removal from the associated vehicle is not only time consuming but also presents a substantial logistic and clerical task. The ideal situation would be one where the parking lot attendants are able to leave keys within the vehicle, yet at the same time placing the keys in a situation such that they cannot be employed by unauthorized personnel.

Various attempts have been made in the prior art to provide an apparatus which will be satisfactory for employment in the above described situations. Typical of these prior art apparatuses are those disclosed in U.S. Pat. Nos.: 3,636,742 issued to G. B. Ranay on Jan. 25, 1972; 3,695,067 issued to R. D. Bays on Oct. 3, 1972; 3,712,091 issued to R. J. Parent on Jan. 23, 1973; 3,742,741 issued to L. L. Cahan on July 3, 1973; and 3,744,281 issued to R. F. Logue et al. on July 10, 1973. Each of these apparatuses provide a means for suspending a locked box from a suitable supporting surface and means for placing a key totally inside the locked box such that the locked box can be locked by a master key and access to the locked key can be precluded. The locked boxes are openable with a master key presumably only available to authorized personnel.

Unfortunately, all of these apparatuses suffer from at least two shortcomings. First of all, it is not known whether or not a key is disposed inside one of these locked boxes unless the locked box is actually opened. This is more than an inconvenience since considerable time can be lost in determining whether or not a key is available as a result of having to open a plurality of boxes. A second shortcoming is that any of these devices can be battered or broken open without any substantial risk of damaging the key disposed therein. As a result, unauthorized personnel can essentially strong arm the locked boxes open and be presented with a perfectly usable key to the total frustration of the intended purpose of these apparatuses.

The present invention overcomes the problems and shortcomings associated with the prior art by providing a key retaining device which does not entirely enclose the retained key and which therefore permits visual inspection of the handle section of the key so that an observer instantly knows whether or not a key is engaged in the device. The present invention also totally destroys the usability of a key clamped therein if unauthorized extraction of the key is attempted in the apparently most logical manner, i.e., by grasping of the exposed handle section thereof and pulling on the same to try to remove the key.

SUMMARY OF THE INVENTION

Therefore, a primary object of the present invention is to provide a key retaining device which will retain and lock a key in a position such that it is unusable unless removed by authorized personnel.

A further object of the present invention is to provide a key retaining device which captures and selectively locks therein only the working section of an inserted key leaving the handle section thereof visible.

A still further object of the present invention is to provide a key retaining device which, upon inspection by an interested party will reveal whether or not a key is present without unlocking of the device.

Still another object of the present invention is to provide a key retaining device which, if unauthorized withdrawal of a key therefrom is attempted, will most likely result in destruction of the key.

Another further object of the present invention is to provide a key retaining device for capturing and selectively locking therein a variety of differently shaped and configured keys.

Another object of the present invention is to provide a key retaining device for capturing and selectively locking therein a key which is suitable for manufacture in as many units as desired, each being openable by a master key.

Another still additional object of the present invention is to provide a key retaining device which may incorporate suitable structure to permit placement of the device on a desired supporting surface.

Another still additional and further object of the present invention is to provide a key retaining device which is simple in design, relatively inexpensive to manufacture, rugged in construction, durable, easy to operate, and efficient in operation.

These objects, as well as further objects and advantages of the present invention, will become readily apparent after reading the ensuing description of the nonlimiting illustrative embodiment and viewing of the accompanying drawing.

A key retaining device for capturing and selectively locking therein a portion of the working section of a key having a work section and a handle section, the device comprising, according to the principles of the present invention: housing means forming a chamber therein, a slot being disposed through a wall of the housing means, the slot being in communication with the chamber and being dimensioned to accommodate therethrough a portion of the working section of the key for insertion into the chamber; and means for selectively securing the portion of the working section of the key when inserted into the chamber of the housing means, either upon or after operation of said securing means.

BRIEF DESCRIPTION OF THE DRAWING

In order that the present invention may be more fully understood, it will now be described, by way of example, with reference to the accompanying drawings in which.

DESCRIPTION OF THE PREFERRED EMBODIMENT

Figure 1:
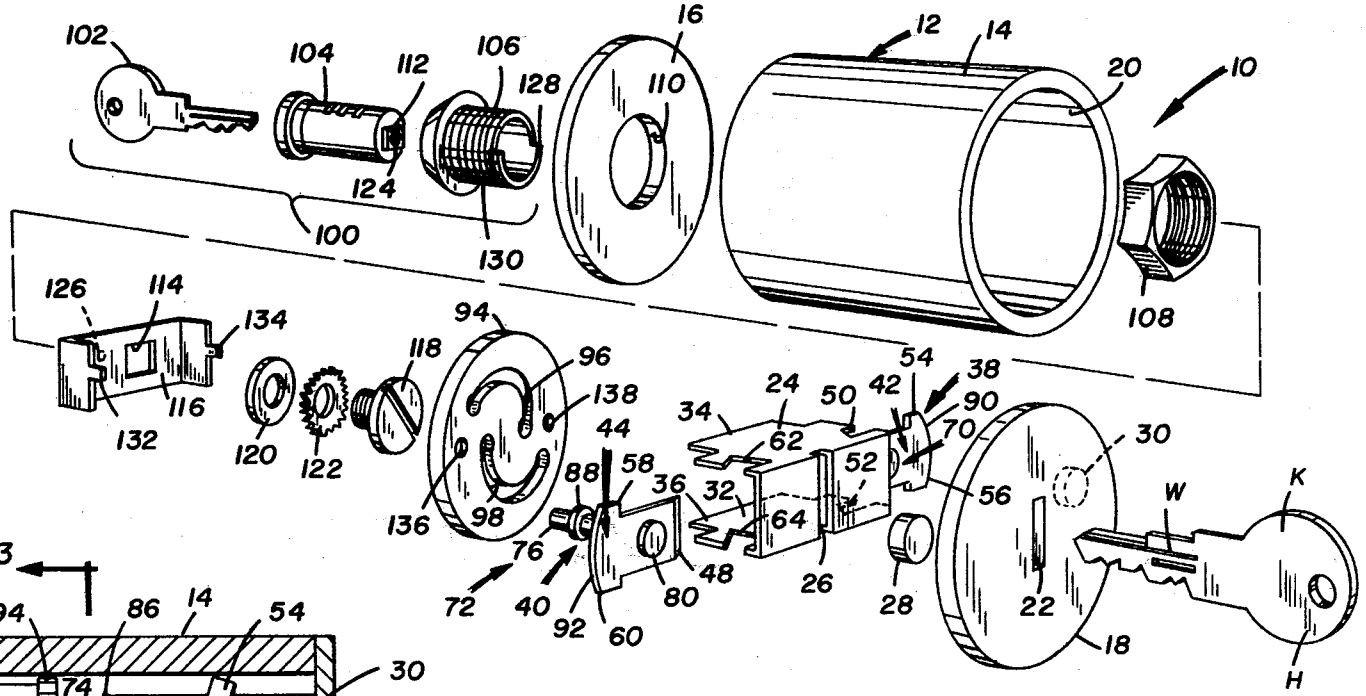
FIG. 1 is an exploded pictorial representation of the components of a key retaining device incorporating the principles of the present invention therein.
Figure 2:
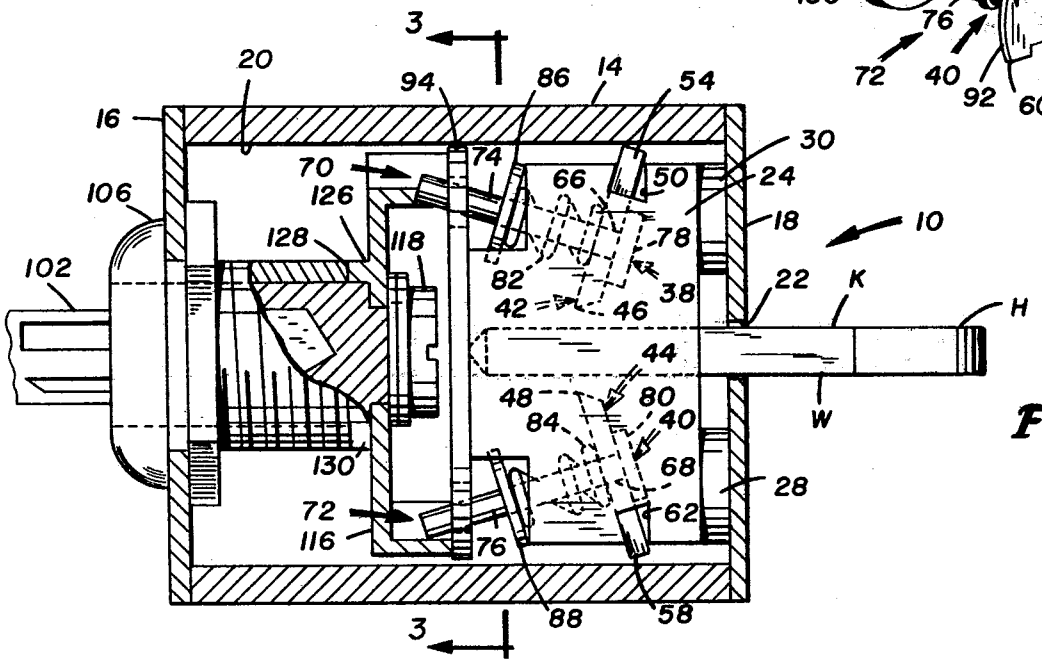
FIG. 2 is a cross sectional view of the key retaining device of the present invention when assembled.

Referring now to the figures, and more particularly to FIGS. 1 and 2 thereof, there is illustrated therein a key retaining device 10 constructed in accordance with the principles of the present invention. The key retaining device 10 includes a housing 12 fabricated from a cylindrical member 14 and first and second end plates 16 and 18. The first and second end plates 16 and 18 are fixedly secured to the cylindrical member 14 when the key retaining device 10 is assembled, as illustrated in the cross sectional view of FIG. 2. The plates 16 and 18 can be affixed to the cylindrical member 14 in one of many conventional manners such as welding or the like to present a housing 12 which is virtually impossible to open. Such assembly techniques are well known in the metal working arts and specifically in the lock fabrication arts. Additionally, the first and second end plates 16 and 18 may be integrally formed with the cylindrical member 14 depending upon manufacturing constraints. As another alternative, the cylindrical member 14 may include a lip, around which the edge portions of the first or second end plates 16 and 18 can be bent or molded to effect closure between the cylindrical member 14 and the first and second end plates 16 and 18. The cylindrical member 14 in conjunction with the first end plate 16 and the second end plate 18, forming the housing 12, forms therein a chamber 20 into which virtually all the components of the present invention are assembled.

The object of the present invention's attentions is a key K which is to be engaged and locked so that it cannot be used, yet positioned such that it can be readily seen if the key retaining device 10 is inspected. The key K is shown in an arbitrary configuration and various differently configured keys may be locked within the key retaining device 10, any of these configurations being characterized in that they have a working section W for insertion into the key retaining device 10 and a handle section H. Working section W of the key K is illustrated as being of a conventional mechanical variety wherein the various teeth thereof position various tumbler elements to open a lock. It is to be understood that the working portion W of the key K could be otherwise configured either for use in mechanical locks, for instance, a key having teeth on both sides, or working section W of key K may be of an entirely different type such as the working section presented in a key used in conjunction with a magnetic lock wherein various magnetic elements are imbedded in an unmachined shank.

A slot 22 is provided in the second end plate 18 to accommodate the working portion W of the key K therethrough such that the working portion W resides within the chamber 20. Fixedly secured to the second end plate 18 is a bracket 24. The bracket 24 is substantially U-shaped and has disposed therein a slot 26 which is of a similar size and which is in substantial alignment with the slot 22 disposed in the second end plate 18 when the bracket 24 is fixedly secured thereto. The bracket 24 is secured to the second end plate 18 and spaced therefrom by a pair of spacers 28 and 30. The spacers 28 and 30 may be integrally formed with the bracket 24 or separate elements, as illustrated, can be employed, the bracket 24 being welded or otherwise affixed thereto using known metal working techniques. Alternately, the bracket 24 and the spacers 28 and 30 can be riveted to the second end plate 18. As still another alternative, tapered lips may be integrally formed with the bracket 24 and these lips, serving in place of the spacers 28 and 30, can be affixed to the second end plate 18.

The bracket 24 forms a key engaging chamber 32 between the legs 34 and 36 thereof, the working portion W of the key K residing within the key engaging chamber 32 when inserted through the slot 22 of the second end plate 18 and the slot 26 of the bracket 24. Also disposed within the key engaging chamber 32 formed by the bracket 24, when the key retaining device 10 is assembled, are a pair of key engaging members 38 and 40. The key engaging members 38 and 40 each comprise, respectively, substantially T-shaped blades 42 and 44, tapered, respectively, to knife edges 46 and 48. The knife edges 46 and 48 are provided for engaging the working section W of the key K as hereinafter described in conjunction with FIGS. 4 and 5.

Although the knife edges 46 and 48, respectively, of the blades 42 and 44 are illustrated in a particular configuration, it is to be understood that these edges can be otherwise configured. For instance, they could be serrated, tapered, bifurcated, beveled, chisel pointed, or the like within the scope of the present invention.

The blade 42 is mounted to the bracket 24 by a pair of notches or slots 50 and 52 disposed, respectively, in legs 34 and 36 of bracket 24. The notches 50 and 52, engage, respectively, ears 54 and 56 provided by and disposed extensively from the blade 42. The notches 50 and 52 are aligned and are trapezoidal in shape to permit tilting of the blade 42 and therefore the ears 54 and 56 thereof, respectively, within the notches 50 and 52.

Blade 44 enjoys a construction virtually the same as that of blade 42 with blade 44 providing a pair of ears 58 and 60 which reside, respectively, in notches or slots 62 and 64, disposed, respectively, in legs 34 and 36 of bracket 24. The notches or slots 62 and 64 are also trapezoidal in shape to permit tilting therein, respectively, of the ears 58 and 60.

Disposed through the blades 42 and 44, respectively, are apertures 66 and 68 which are dimensioned to accommodate therethrough, respectively, pins 70 and 72. The pins 70 and 72, respectively, include shank portions 74 and 76 and head portions 78 and 80. The shank portions 74 and 76 preclude movement of the pins 70 and 72, respectively, through the apertures 66 and 68. The shank portions 74 and 76 are slightly smaller in diameter than the apertures 66 and 68 so that the longitudinal axes of the pins 70 and 72 can tilt relative to the planes in which the blades 42 and 44 reside.

The pins 70 and 72 each have respectively disposed therearound helical compression springs 82 and 84, one end of the springs 82 and 84 being in contact, respectively, with the blades 42 and 44, the other ends of the helical compression springs 82 and 84 butting up against, respectively, washers 86 and 88, also disposed on the shank portions 76 and 78, the washers 86 and 88 being maintained, respectively, on the shank portions 76 and 78 of the pins 70 and 72 by a plurality of integrally formed protrusions formed in the shank portions 74 and 76. Alternately, other suitable means may be provided for fixing the position of the washers 86 and 88, such as pins, welding, or the like, respectively, relative to the shank portions 74 and 76 of the pins 70 and 72. As a result of employment of the helical compression springs 82 and 84, the pins 70 and 72 have their longitudinal axes substantially normal to the planes in which the blades 42 and 44 reside when the pins 70 and 72 are in a rest position but, when force is exerted on the end of the pins 70 and 72, the longitudinal axes of the pins 70 and 72 become skewed relative to the planes in which the blades 42 and 44 reside, as further illustrated in FIG. 5. The springs 82 and 84 therefore serve to spring dampen movement between the pins 70 and 72 and the blades 42 and 44.

The blades 42 and 44 are maintained within the key engaging chamber 32 of the bracket 24 such that the ears 54 and 56 are disposed within the notches 52 and 54 and the ears 58 and 60 are disposed within the notches 62 and 64 as a result of the cylindrical member 14 being dimensioned with a diameter just slightly larger than the distance between the outer edges 90 and 92, respectively, of the blades 42 and 44 with the outer edges 90 and 92 of the blades 42 and 44 being curved to approximate the internal curvature of the cylindrical member 14. As a result, when the bracket 24 is within the chamber 20 formed by the housing 12, the ears 54 and 56, and 58 and 60, respectively, of the blades 42 and 44 are trapped in position.

Figure 3:
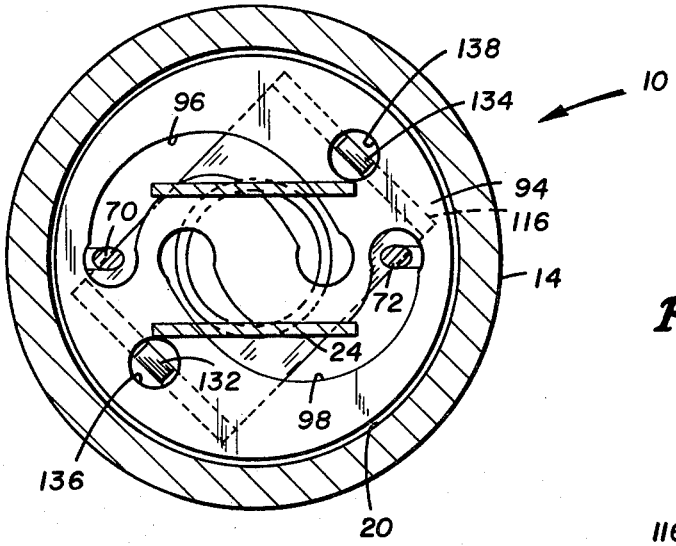
FIG. 3 is a cross sectional view of an assembled key retaining device taken from a position illustrated by lines 3—3 of FIG. 2.
Figure 4:
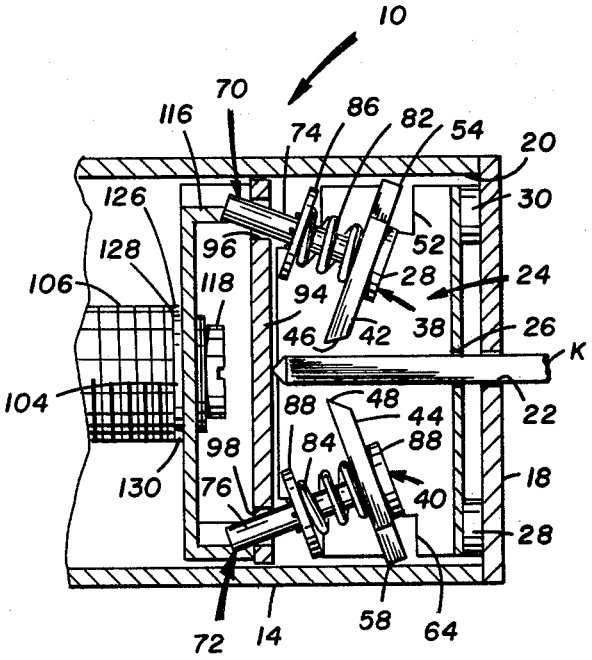
FIG. 4 is a fragmentary cross sectional view of a key retaining device, incorporating the principles of the present invention, in an open or unlocked position.
Figure 5:
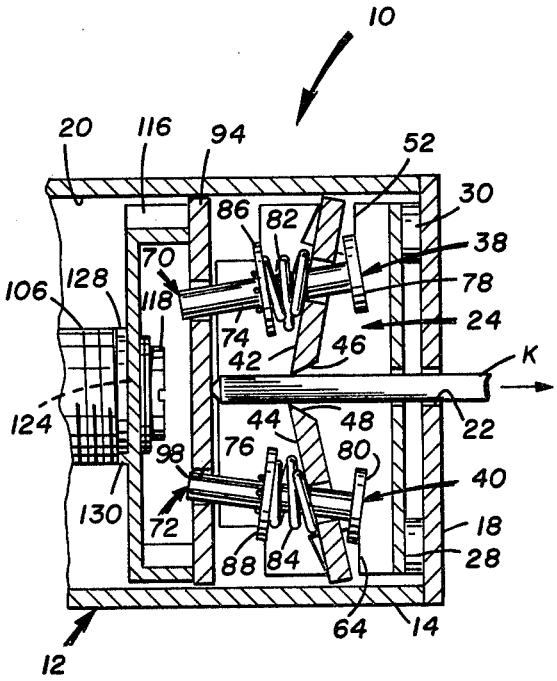
FIG. 5 is a fragmentary cross sectional view of a key retaining device, incorporating the principles of the present invention, in a closed or locked position.

Manipulation of the pins 70 and 72 as hereinafter discussed in conjunction with FIGS. 4 and 5 is accomplished through rotation of a dual channeled cam 94. The cam 94 is a substantially flat circular plate and has a pair of semi-circularly shaped channels 96 and 98 disposed therethrough, channel 96 for engaging the end of the pin 70, channel 98 for engaging the end of the pin 72 as illustrated in FIGS. 2, 3, 4, and 5. Rotation of the dual channeled cam 94 causes movement of the pins 70 and 72 together and apart to cause engagement and disengagement of the working portion W of the key K by the knife edges 46 and 48 of the blades 42 and 44 as illustrated in FIGS. 4 and 5. This is accomplished since the inner ends of the channels 96 and 98 are closer to the center of the cam 94 than the outer ends thereof, therefore providing the drawing together and separating of the pins 70 and 72. The channels 96 and 98 are spaced apart, nonaligned as illustrated, and are slightly enlarged at the inner ends thereof to provide resting positions for the pins 70 and 72 when the blades 42 and 44 are clamped about the work section W of the key K.

Selective rotation of the dual channeled cam 94 is accomplished by a conventional master key and lock assembly 100. The master key and lock assembly 100 includes a master key 102, a tumbler 104, an armored mounting sleeve 106, and a nut 108. The mounting sleeve 106 is inserted through an aperture 110 in the first end plate 16 and is secured in position by the nut 108 which threadably engages the exterior threads disposed on the mounting sleeve 106. This mounts the tumbler 104 so that when the master key 102 is disposed therein its longitudinal axis is substantially aligned with the longitudinal axis of the key K when inserted in the device 10. The master key 102 and the tumbler 104 are of a conventional design, rotation of the tumbler 104 being permitted within the mounting sleeve 106 when the proper key is inserted therein. The tumbler 104 provides an engaging protrusion 112 on the end thereof disposed within the cylindrical member 14 in the chamber 20 formed thereby and is dimensioned to be captured within an aperture 114 disposed through a bracket 116. The bracket 116 is held onto the end of the tumbler 104 by a screw 118, a washer 120, and a lock washer 122, the screw threadably engaging a threaded aperture 124 disposed in the end of the tumbler 104. When the master key 102 is inserted into the tumbler 104 so that the rotation thereof is permitted within the mounting sleeve 106, rotation of the tumbler 104 also causes rotation of the bracket 116. A stop 126 is provided on the bracket 116 and limits the rotation of the bracket 116 as the stop 126 engages shoulders 128 and 130 provided at the inner end of the mounting sleeve 106. The bracket 116 causes rotation of the dual channeled cam 94 by a pair of protrusions 132 and 134 which engage, respectively, a pair of apertures 136 and 138 disposed in the dual channeled cam 94 as further illustrated in FIG. 3. Therefore rotation of the master key 102 causes rotation of the dual channeled cam 94 and manipulation of the blades 42 and 44 such that working section W of the key K can be engaged.

With specific reference to FIG. 2, the key retaining device can be seen in an open position wherein the blades 42 and 44, respectively, of the key engaging members 38 and 49 are disengaged from the working portion W of the key K as a result of the dual channeled cam 94, through the channels 96 and 98 thereof, urging, respectively, the shank portions 74 and 76, respectively, of the pins 70 and 72 into a spread apart relationship, such a condition also being illustrated in FIG. 4.

As the dual channel cam 94 is rotated, the pins 70 and 72 are drawn toward each other by virtue of the shape of the channels 96 and 98, as hereinbefore described, so that they are in a position as illustrated in FIG. 5. This causes the knife edges 46 and 48, respectively, of the blades 42 and 44 of the key engaging members 38 and 40 to bite into and firmly engage the working portion W of the key K to lock the key K in position. When the cam 94 is rotated into this position by the master key 102 and the master key 102 is withdrawn, the key K is maintained in position within the key retaining device 10 and is locked in such position by the positioning of the pins 70 and 72 in the aforedescribed enlarged inner portions of the channels 96 and 98.

If an attempt is made to withdraw the key K from the key retaining device 10, when in a locked condition, the blades 42 and 44 bite into the working section W of the key K. If one is nevertheless persistent in pulling the key K from the locked key retaining device 10, if the key can indeed be removed therefrom, this action will cause cutting and/or severe damage to the key such that it will not be able to function for its intended purpose. This is an interesting aspect of the present invention as compared to the prior art. When an unauthorized person is confronted with a key locked in the key retaining device 10, and if such person wants to withdraw the key, normal instincts will tempt this unauthorized person to yank the key out of the housing thus causing the key to be damaged and therefore to be unusable, if the key can be removed. This is in contrast to the prior art devices where normal instincts of an interloper would lead him to break open the key retaining chambers of prior devices damaging the housings thereof but leaving the key stored therein unharmed for use.

The operation of the invention is not limited to the aforementioned sequence of insertion of portion W of key K into slot 20 followed by rotation of 94 by means of master key 102. The sequence may be reversed, namely Cam 94 is rotated into the retaining position by rotation of master key 102. This causes pins 70 and 72 to move blade edges 46 and 48 of blades 42 and 44 towards each other. At this juncture helical springs 82 and 84 are not under full compression. End W of key K is then inserted through slot 20 forcing knife edges 46 and 48 apart from each other and causing substantially full compression of springs 82 and 84. The action of springs 82 and 84 upon knife edges 46 and 48 acting upon end W of key K preclude removal of key K because of the angle at which knife edges 46 and 48 act upon said end W.

Through observing FIGS. 3, 4 and 5, it can be seen that as the master key 102 is rotated and the dual channel cam 94 acts upon the pins 70 and 72, the knife edges 46 and 48, respectively, of the blades 42 and 44 define a plane which is at all times substantially perpendicular to the longitudinal axis of the working section W of the key K, this plane moving toward the handle section H of the key K. When unlocking of the key K is desired, one merely needs to insert the master key 102 in the tumbler 104 and rotate the same in a direction opposite that used for locking, this separating the pins 70 and 72, as illustrated in FIG. 5, and therefore the blades 42 and 44 so that the key K can be easily withdrawn from the device 10.

By providing a plurality of key retaining devices 10 all having their tumblers 104 keyed alike, a single master key 102 can be used to access all of the thusly constructed devices while each device can lock a key in position so that it can not be used by unauthorized personnel and yet is still readily visible if a question arises as to whether or not a key is present. The housing 12 can incorporate any suitable structure such as a bracket, bail, clamp, hook, or the like to position the key retaining device 10 at a suitable location depending from a chosen supporting surface. The housing components of the present invention are preferably constructed of hardened steel or the like and the internal components of the key retaining device 10 are constructed of metal or other suitable materials well known in the art for use in such applications.

It should be understood that various changes in the details, materials, arrangements of parts, and operational conditions which have been herein described and illustrated in order to explain the nature of the invention may be made by those skilled in the art within the principles and scope of the invention.

Having thus set forth the nature of the invention, what is claimed is:

1. A key retaining device for capturing and selectively locking therein a portion of the working section of a key having a working section and a handle section, said device comprising:

housing means forming a chamber therein, a slot disposed through a wall of said housing means, said slot being in communication with said chamber and dimensioned to accomodate therethrough said portion of said working section of said key for insertion into said chamber; and means for selectively securing said working portion of said key within said chamber, including clamp means having an open and an engaging position, said clamp means comprising:

a plurality of key engaging members, each including a blade, the edge of which is engageable with said working section of the key, and which by the resulting wedging action prevents withdrawal of said key from said slot, and selective locking means comprising:

a master key and lock assembly mounted on said housing means, insertion of said master key into said lock assembly permitting the rotation of a member which moves the blades into and out of engagement with said working section of the key.

2. A key retaining device in accordance with claim 1, wherein insertion of said master key into said lock assembly permits the rotation of the cylinder portion of said lock assembly, rotation of said cylinder portion in one direction opening said clamp means, rotation of said cylinder portion in the opposite direction moving said clamp means to engaging position.

3. A key retaining device in accordance with claim 2, wherein said clamp means comprises a pair of reciprocatable key engaging members each comprising a blade having an edge for engaging the working section of the key, said key engaging members being spaced apart and being drawn together to clamp a portion of said working section of said key therebetween and being separated to release the same.

4. A key retaining device in accordance with claim 3, wherein said edge of each of said blades is substantially disposed in and substantially reciprocates in a moving plane, said plane being substantially perpendicular to the longitudinal axis defined by said working section of said key.

5. A key retaining device in accordance with claim 3, said clamp means further comprising bracket means for mounting said reciprocatable key engaging members, said bracket means being fixedly secured to said housing means, said bracket means providing two pair of mounting slots, each of said slots of each of said pairs engaging a portion of one of said key engaging members, said slots being configured to permit tilting of said key engaging members, said tilting causing said reciprocation.

6. A key retaining device in accordance with claim 5, wherein each of said key engaging members further comprises a pin affixed thereto, said selective locking means further comprising a dual channeled cam, each of said channels engaging one of said pins, said cam being mounted to said cylinder portion of said lock assembly, rotation of said cam by said cylinder causing said channels to move said pins and therefore said key engaging members toward said working section of said key.

7. A key retaining device in accordance with claim 6, wherein said dual channel cam comprises a substantially flat plate, said channels being substantially semi-circular in shape and spaced apart.

8. A key rotating device in accordance with claim 6, wherein said pins are affixed to said key engaging members such that spring dampened movement between said pins and said key engaging members is permitted.

9. A key retaining device in accordance with claim 8, wherein said spring dampened movement is accomplished by said pins each including a head and being disposed through an aperture disposed in the associated said key engaging member, said heads precluding movement of said pins through said apertures of said key engaging members, said apertures being larger than the diameter of said pins, said key engaging means further comprising a pair of helical compression springs, one of said springs being disposed about each of said pins, one end of each of said springs being in contact with said key engaging members adjacent to said apertures, the other ends of said springs being affixed to said pins.

10. A key retaining device in accordance with claim 5, wherein said key engaging members are retained within said slots by said housing means.

11. A key retaining device in accordance with claim 2, wherein the longitudinal axes defined by said key and said master keys are aligned when both are inserted into said device.

12. A key retaining device in accordance with claim 1, further comprising means for removably affixing said housing means to a selected object.

13. A key retaining device for capturing and selectively locking therein a portion of the working section of a key having a working section and a handle section, said device comprising:

housing means forming a chamber therein, a slot being disposed through a wall of said housing means, said slot being in communication with said chamber and being dimensioned to accommodate therethrough said portion of said working section of said key for insertion into said chamber; and means for selectively securing said portion of said working section of said key within said chamber, said selective securing means comprising clamp means having an open and an engaging position, said clamp means comprising a pair of reciprocatable key engaging members, said key engaging members being spaced apart and being drawn together to clamp a portion of said working section of said key therebetween and being separated to release the same, said key engaging members each comprising a blade, the edges of said blade for engaging said working section of said key, said edge of each of said blades being substantially disposed in and substantially reciprocatable in a moving plane, said plane being substantially perpendicular to the longitudinal axis defined by said working section of said key, said clamp means further comprising bracket means for mounting said reciprocatable key engaging members, said bracket means being fixedly secured to said housing means, said bracket means providing two pair of mounting slots, each of said slots of each of said pairs engaging a portion of one of said key engaging members, said slots being configured to permit tilting of said key engaging members, said tilting causing said reciprocation, said key engaging members being retained within said slots by said housing means, each of said key engaging members further comprising a pin affixed thereto, said selective locking means further comprising a dual channel cam, said dual channel cam comprising a substantially flat plate, said channels being substantially semi-circular and spaced apart, each of said channels engaging one of said pins, rotation of said cam by said selective locking means causing said channels to move said pins and therefore said key engaging members toward said working section of said key, said pins being affixed to said key engaging members such that spring dampened movement between said pins and said key engaging members is permitted, said spring dampened movement resulting from said pins each including a head and being disposed through an aperture disposed in the associated said key engaging member, said heads precluding movement of said pins through said apertures of said key engaging members, said apertures being larger than the diameter of said pins, said key engaging means further comprising a pair of helical compression springs, one of said springs being disposed about each of said pins, one end of each of said springs being in contact with said key engaging members adjacent to said apertures, the other ends of said springs being affixed to said pins, and means for selectively locking said clamp means in said open and said engaging positions, said selective locking means comprising a master key and lock assembly mounted in said housing means, insertion of said master key into said lock assembly permitting the rotation of said cylinder portion of said lock assembly, said cam being mounted to said cylinder portion of said lock assembly, rotation of said cylinder causing rotation of said cam, rotation of said cylinder portion in one direction therefore opening said clamp means, rotation of said cylinder portion in the opposite direction therefore closing said clamp means, to key engaging position, the longitudinal axes defined by said key and said master key being aligned.

14. A key retaining device for capturing and selectively locking therein a portion of the working section of a key having a working section and a handle section, said device comprising:

housing means forming a chamber therein, a slot disposed through a wall of said housing means, said slot being in communication with said chamber and dimensioned to accommodate therethrough said portion of said working section of said key for insertion into said chamber, clamp means within said chamber engageable with said working section having an open and an engaging position, said clamp means comprising a plurality of key engaging members, each including a blade, the edge of which engages the working section of said key and by wedging thereagainst prevents withdrawal of said key working section from said slot, and a master key and lock assembly mounted on said housing means, insertion of said master key into said lock assembly permitting the rotation of the cylinder portion of said lock assembly, rotation of said cylinder portion in one direction opening said clamp means, rotation of said cylinder portion in the opposite direction moving said clamp means to engaging position.

* * * * *